US007178692B2

(12) United States Patent
Ophardt

(10) Patent No.: US 7,178,692 B2
(45) Date of Patent: Feb. 20, 2007

(54) PASTE DISPENSER WITH CENTER POST

(75) Inventor: Heiner Ophardt, Vineland (CA)

(73) Assignee: Hygiene-Technik Inc., Beamsville (CA)

( * ) Notice: Subject to any disclaimer, the term of this patent is extended or adjusted under 35 U.S.C. 154(b) by 518 days.

(21) Appl. No.: 10/807,097

(22) Filed: Mar. 24, 2004

(65) Prior Publication Data

US 2005/0029292 A1 Feb. 10, 2005

(30) Foreign Application Priority Data

Aug. 5, 2003 (CA) ..... 2436634
Feb. 27, 2004 (CA) ..... 2459617

(51) Int. Cl.
*B65D 35/28* (2006.01)

(52) U.S. Cl. ..... 222/104; 222/95; 222/99; 222/100; 222/105; 222/333

(58) Field of Classification Search ..... 222/94–95, 222/104, 99–100, 105, 107, 325–326, 333, 222/386, 504
See application file for complete search history.

(56) References Cited

U.S. PATENT DOCUMENTS 2,376,222 A 5/1945 Barlow
2,502,918 A 4/1950 Beresford
2,562,937 A * 8/1951 Moricich ..... 222/104
2,616,422 A * 11/1952 Jones ..... 604/214
2,634,025 A * 4/1953 Hausner ..... 222/104
2,721,676 A * 10/1955 Andrews ..... 222/104
2,723,779 A * 11/1955 Parker et al. ..... 222/104
3,302,832 A * 2/1967 Anderson et al. ..... 222/94
3,407,968 A 10/1968 Fiquet et al.
3,593,885 A * 7/1971 Wiggins et al. ..... 222/104
3,860,147 A 1/1975 Vessio et al.
3,870,198 A 3/1975 Cohen
4,132,330 A 1/1979 Rauscher et al.
4,332,497 A 6/1982 Rodriguez
4,895,276 A 1/1990 Maldonado
5,042,691 A 8/1991 Maldonado
5,638,989 A 6/1997 Ophardt
5,791,525 A 8/1998 Fan
5,931,397 A 8/1999 Herman et al.
6,257,450 B1 7/2001 Jackson et al.
6,347,726 B1 2/2002 Jackson et al.
6,401,977 B1 6/2002 Ross, III

* cited by examiner

*Primary Examiner*—Frederick C. Nicolas
(74) *Attorney, Agent, or Firm*—Riches, McKenzie & Herbert LLP

(57) ABSTRACT

A method of and apparatus for dispensing paste from a collapsible container elongate about an axis from a first closed end to a second open end, the method comprising rotating one of the first end and second end relative to the other to twist the container about the axis, thereby collapsing the container, compressing paste contained therein and extruding the paste from the second open end.

22 Claims, 14 Drawing Sheets

PASTE DISPENSER WITH CENTER POST

SCOPE OF THE INVENTION

This invention relates to material dispensers and, more particularly, to a dispenser for dispensing paste-like material from a tubular container by twisting of the tubular container.

BACKGROUND OF THE INVENTION

Various dispensers such as cocking guns are adapted for dispensing paste in which a piston displaces the paste from a cylindrical tube. Soap dispensers are known in which soap and other fluids may be dispensed from containers as by the activation of a manually operated or automated pump.

Prior art devices such as piston driven cocking gun type mechanisms and liquid pumps are not conveniently adaptable for controlled, manual or automated dispensing of pastes.

SUMMARY OF THE INVENTION

To at least partially overcome these disadvantages of previously known devices, the present invention provides a simplified arrangement for dispensing material from a deformable container by collapsing the container through twisting.

An object of the present invention is to provide a simplified dispenser for materials and, more particularly, for pastes or viscous fluids.

Another object of the present invention is to provide an apparatus adapted to collapse a tube by twisting the same.

In one aspect, the present invention provides a method of and apparatus for dispensing paste from a collapsible container elongate about an axis from a first closed end to a second open end, the method comprising rotating one of the first end and second end relative to the other to twist the container about the axis, thereby collapsing the container, compressing paste contained therein and extruding the paste from the second open end.

A guide rod may be provided inside the container along the axis upon which the container may collapse on twisting, preferably with the first closed end of the container initially secured to or collapsed about the guide rod. The guide rod may have an external portion which extends from the interior of the container and serve as a mechanism to relatively rotate or hold one end of the container. The guide rod may be hollow and either guide paste internally to the exit or to extend out through the exit. A spring may be provided internally in the container to bias the ends of the container apart, and the spring may also comprise the guide rod.

In another aspect, the present invention provides a dispenser for material comprising:

a collapsible container elongate about an axis from a first end to a second end, the container closed but for an outlet open at one of the first end and the second end, a housing to receive the container with the first end of the container secured to the housing substantially against rotation about the axis relative to the housing, the second end of the container secured in the housing journalled for rotation about the axis in a first direction and against rotation in an opposite direction to the first direction, an activation mechanism for rotating the second end of the container in the one direction, whereby rotating the second end of the container about the axis twists the container about the axis compressing material therein and extruding the material from the outlet.

DETAILED DESCRIPTION OF THE DRAWINGS

Figure 1:
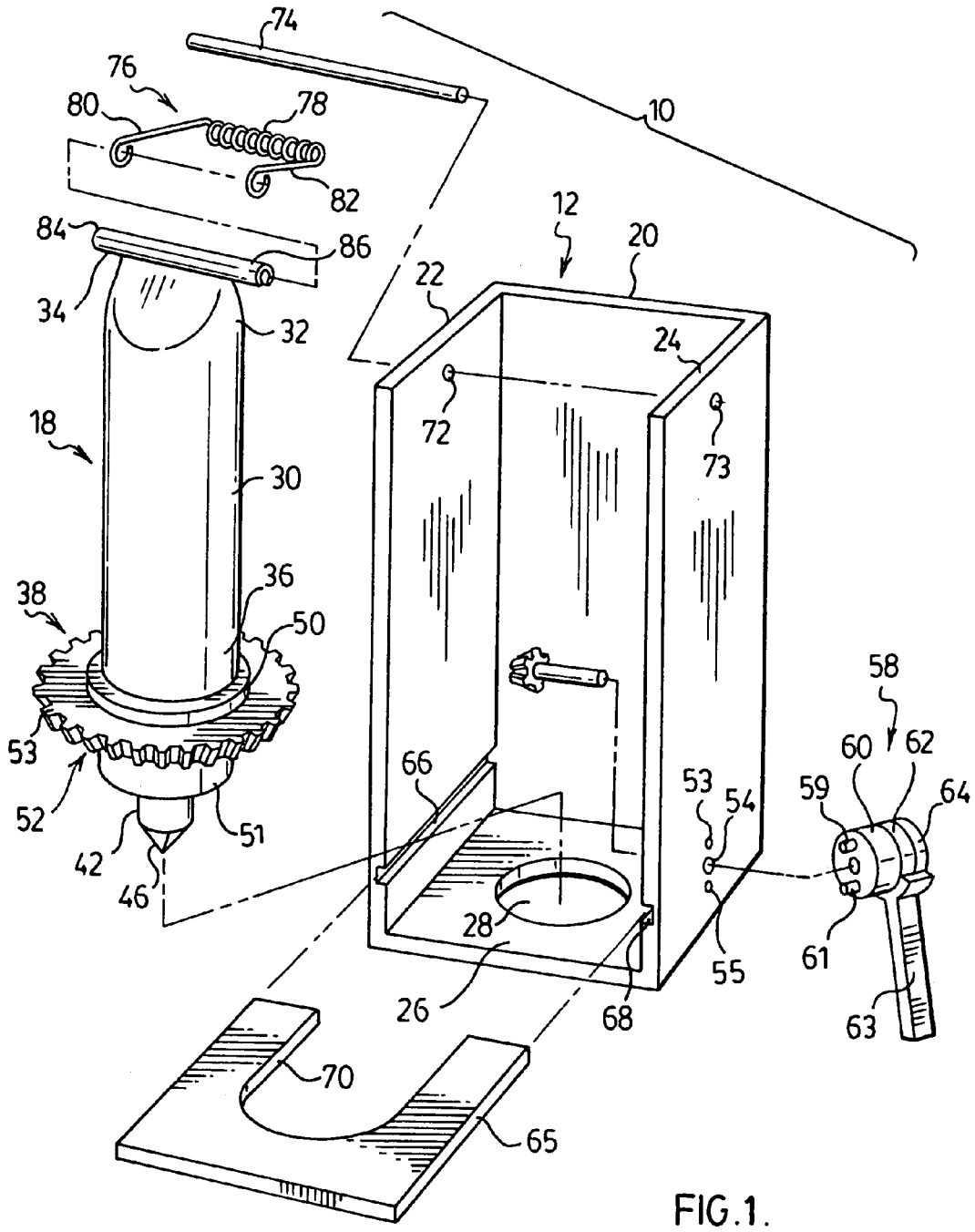
FIG. 1 is a schematic exploded view of a dispenser in accordance with the first embodiment of the present invention.

Further aspects and advantageous of the present invention will become apparent from the following description taken together with the accompanying drawings in which:

Reference is made first to FIGS. 1 to 5 which show a first embodiment in accordance with the present invention and in which a dispenser 10 is shown comprising a housing 12 within which a paste filled container 18 is to be received. The housing 12 is shown as having a rear wall 20, two side walls 22 and 24 and a floor 26. A cylindrical opening 28 extends downwardly through the floor. The container 18 comprises a cylindrical tube 30 held closed at a first upper end 32 by a closure pin 34 and having an open, second lower end 36 received in a cap 38.

The second end 36 of the tube 30 presents an outlet from the tube 30 which is sealably secured to the cap 36 in communication with an inlet opening to the cap 38 to an internal passageway 40 through the cap to an outlet nozzle 42 from which material is to be dispensed. Preferably, as best seen in FIGS. 2 and 3, a one-way valve is provided in the nozzle 42 comprising a plurality of resilient flexible vanes 46 which are biased to assume a closed position as shown in FIG. 3 yet will deflect away from their mutual edges to permit material to be dispensed outwardly.

Figure 2:
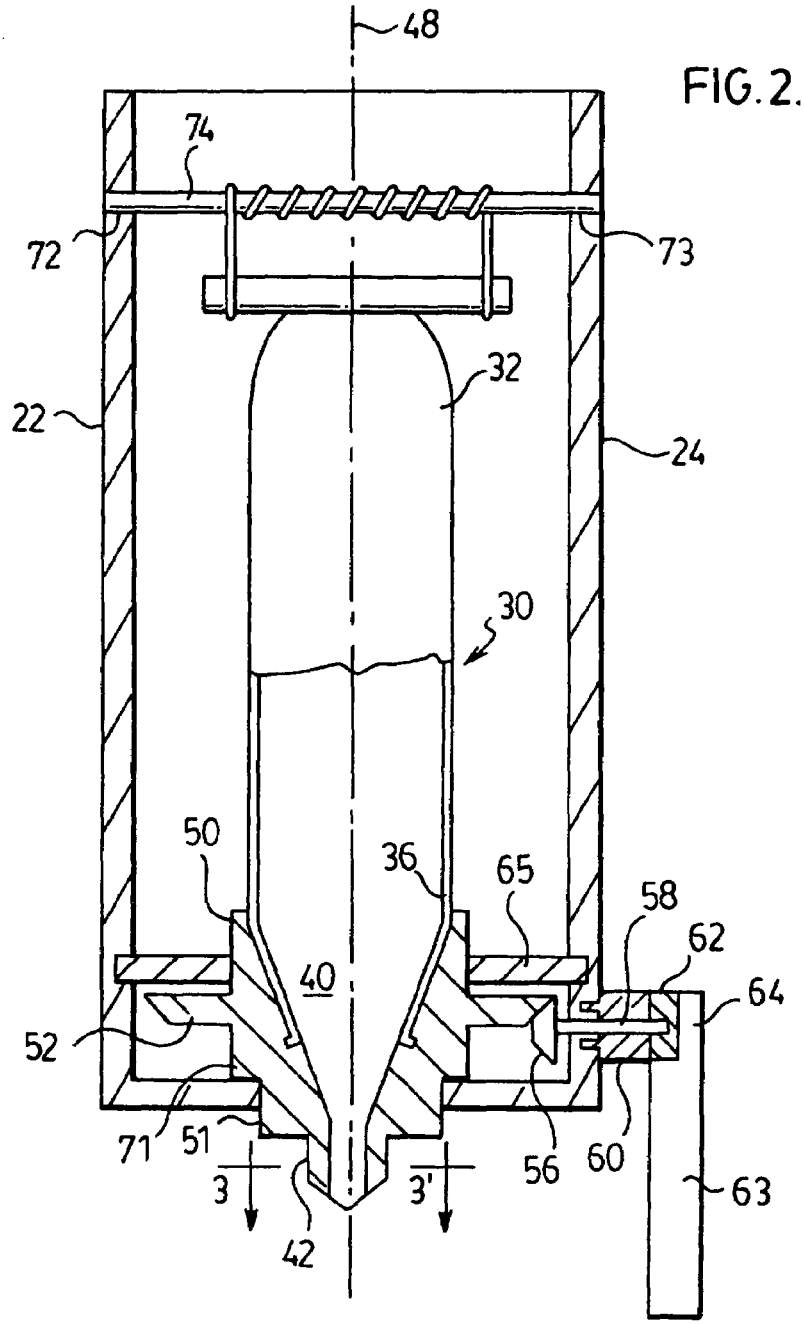
FIG. 2 is a schematic cross-sectional front view of the dispenser of FIG. 1.
Figure 3:
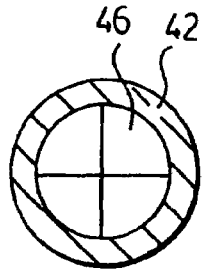
FIG. 3 is a cross-sectional view along section line 3–3' in FIG. 2.
Figure 4:
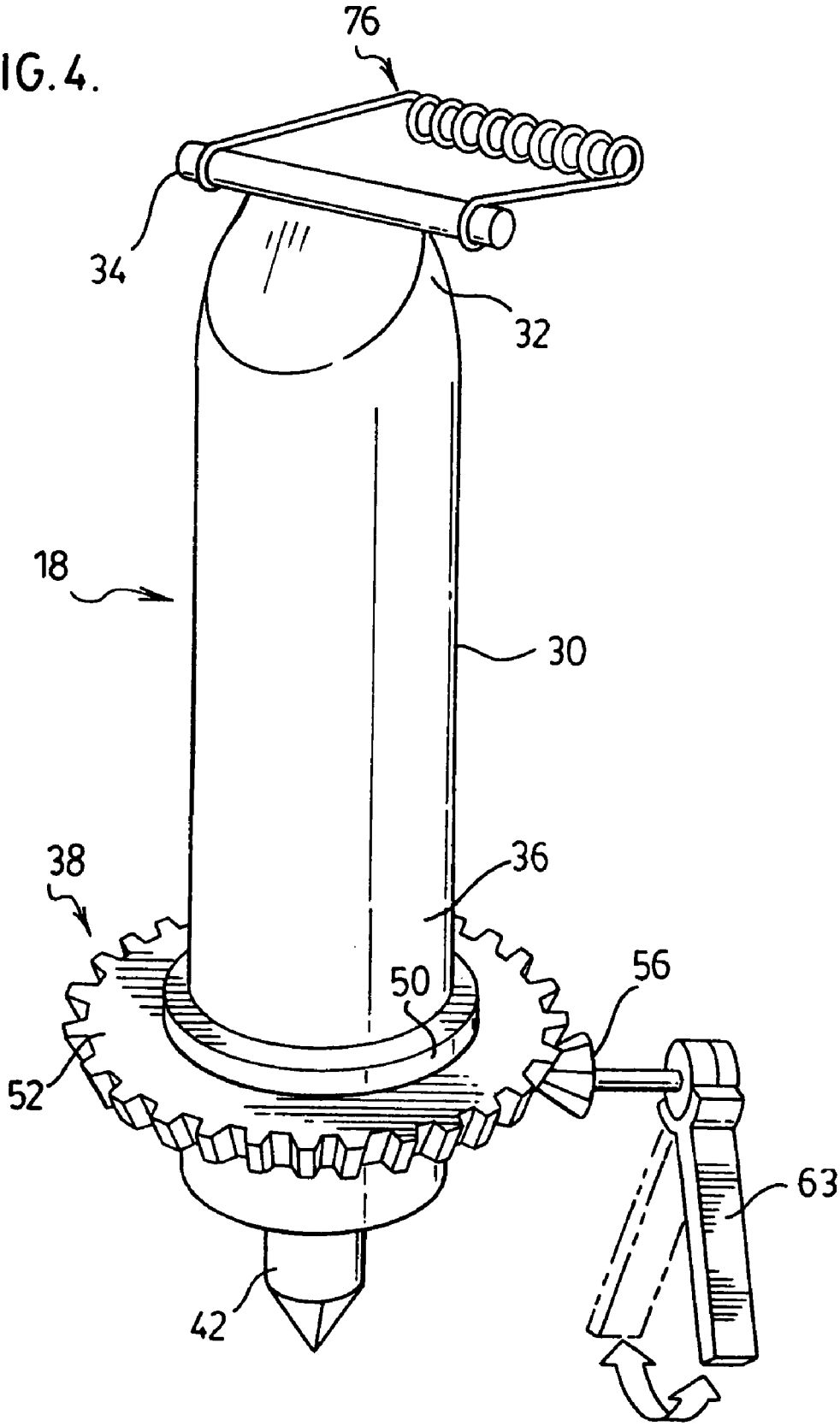
FIG. 4 is a schematic pictorial view of selected components of the dispenser of FIG. 1 with the tube in a filled condition.

As best seen in FIG. 2, the tube 30 extends from the first end 32 to the second end 36 about an axis 48. The tube 30 is a cylindrical tube coaxially about the axis 48. The cap 38 externally carries an upper bearing flange 50 and a lower bearing flange 51 each of which have surfaces which are disposed coaxially about the axis 48. The cap 38 also carries a radially outwardly extending activation flange 52 which carries gear teeth 53 on its perimeter.

The side wall 24 has a bore 54 and two locating holes 53 and 55 in which there is mounted a activation mechanism comprising a bevel gear 56 mounted on an axle 58 to be journalled within the bore 54. A ratchet mechanism 58 is provided which has a fixed disc 60 fixably coupled to the housing side wall 24 by pins 59 and 61 being received in holes 53 and 55. The axle 56 extends through the fixed disc 60 and is fixedly coupled to a one-way rotatable clutch disc 62. The clutch disc 62 may rotate with the gear 56 only in one direction relative the fixed disc 60. A ratchet lever 63 and its disc 64 is journalled to the clutch disc 62 for rotation about the same axis as the axle 58. The ratchet lever 63 on rotation of the lever 63 in one direction causes rotation of the gear 56 the same direction. On rotation of the lever 63 in the other direction, the lever 63 rotates; however, the clutch disc 62 does not rotate. Rotation of the lever 63 in a first direction will rotate the clutch disc and thereby the axle and the gear 56 in the one direction. On rotation of the lever in the other direction, the lever and its disk 64 will move in that direction, however, the clutch disc 62, axle and gear 56 will not rotate in the other direction and their position will remain unchanged.

In an assembled condition as shown in FIG. 2, via movement of the lever 63 in one direction, the gear 56 will engage the activation flange 52 and thus rotate the cap 38 and, hence, the second end 36 of the tube 30 relative to the first end 32.

Assembly of the dispenser of FIG. 1 is accomplished by locating the container 18 within the housing 12 and moving it vertically downwardly so as to locate the lower bearing flange 51 within the opening 28 in the floor 26. Subsequently, a slide plate 65 is slid horizontally into two slots 66 and 68 in the side walls 22 and 24. The slide plate 65 has a U-shaped interior bearing surface 70 which closely engages the upper bearing flange 50. As seen in FIG. 2, the cap 38 is secured to the housing 12 journalled for rotation about the axis 48 by reason of the lower bearing flange 51 being journalled within the opening 28 of the floor 26 and the upper bearing flange being journalled within the bearing surfaces 70 of the slide plate 65. As well, the cap 38 is located against movement axially relative to the housing 12 as with the activation flange 52 extending below the slide plate 64 and a shoulder 71 engaging the floor 26.

It will be appreciated that in vertically sliding the container 18 down into the opening 28 of the housing base 14, that the gear teeth 53 on the activation flange 52 come into engagement with the gear 56.

At an upper end of the housing, the side walls 22 and 24 have holes 72 and 73 there through within which a support rod 74 extends. A metal retaining spring 76 has a helical coil 78 to extend about the support rod 74 and two hook arms 80 and 82 which extend away from the coil at each end thereof. The hook arms 80 and 82 engage about the distal ends 84 and 86 of the closure pin 34 which is fixably secured to and closes, as by clamping, the upper end 32 of the tube 30.

The metal retaining spring 76 thus engages the first end of the container 18 and substantially prevents the same from rotating about the axis 48. Since the coil 78 is journalled on the support rod 74, the relative height of the closure pin 34 is permitted to change depending upon the angular orientation of the hook arms relative to the support rod 74. This permits variance of the relative height of the closure pin 34 and thus the first end 32 of the container 18 relative to the second end 36.

Figure 5:
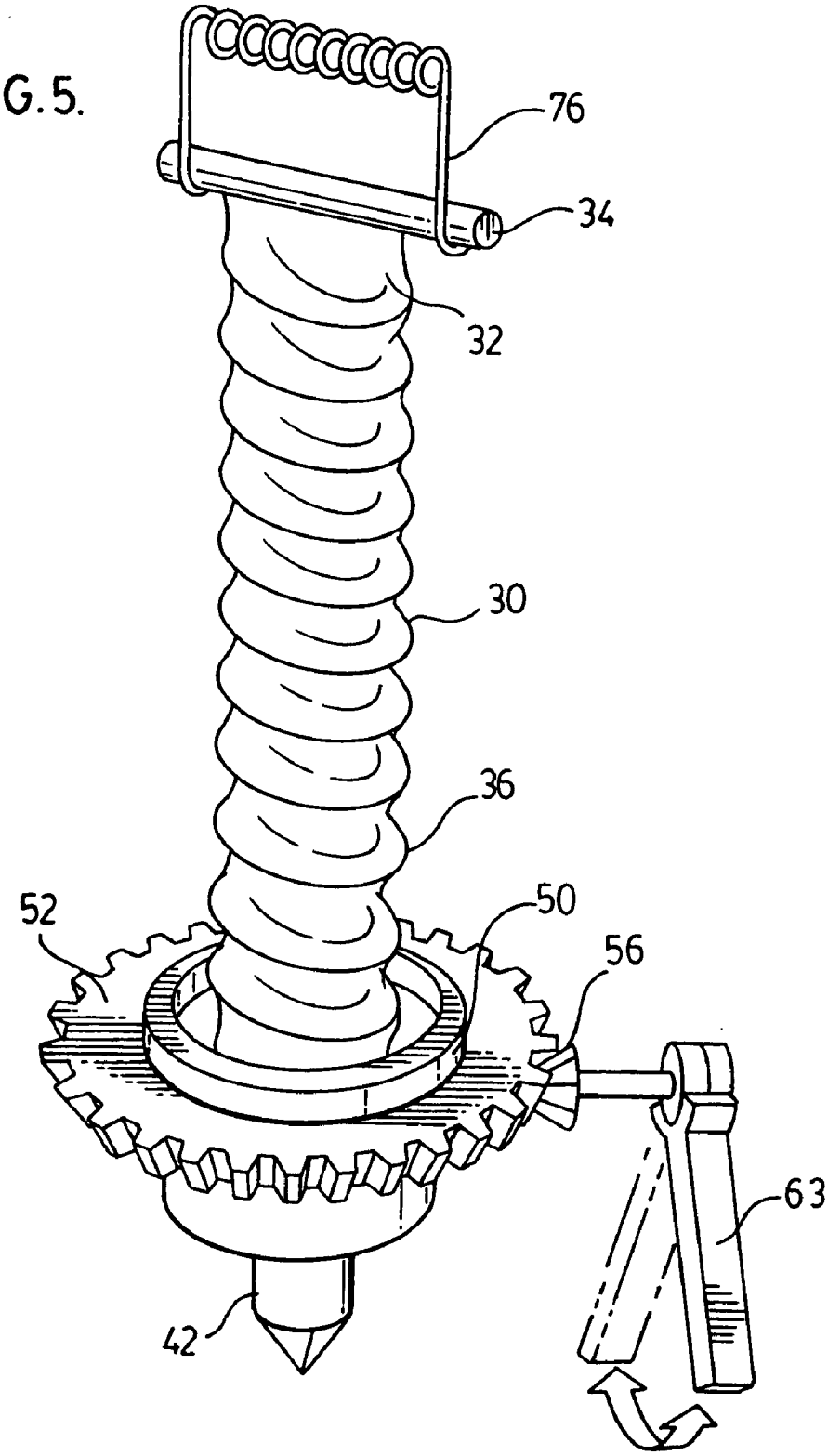
FIG. 5 is a view similar to that of FIG. 4, however, after the tube has been twisted for dispensing fluids.

With rotation of the cap 38, the second end 36 of the tube 30 is rotated relative to the first end 32. With rotation of the tube 30 about the axis 48, the tube becomes twisted and contracts thus applying pressure to the material within the tube such that material under pressure becomes extruded from the nozzle 42 out of the one-way valve 46. FIG. 5 illustrates a condition in which the cap 38 been rotated and thus the tube 30 has become twisted and is compressed.

The tube 30 preferably comprises a relatively flexible tube of plastic film, however, may comprise any material which permits twisting to pressurize the material therein without rupturing. For certain materials, cloth or fabrics or composite flexible sheet like films may be used.

In the preferred embodiment, the second end 36 of the tube 30 is shown as secured to the interior surface of the cap 38 as by gluing or welding. The closure pin is shown as a tube-like member with an axially extending slot to receive the first end of the tube 30 therein and to be crimped upon the tube to close the same. The closure pin 34 may be secured onto the tube 30 via adhesion or welding or by a mechanical clasp. In the preferred embodiment illustrated in FIG. 1, the container 18 comprises an integral element which is intended for replacement and disposal whenever the material from the container may be fully dispensed. Preferably, therefore, the entirety of the tube 30, the closure pin 34 and the cap 38 may comprise recyclable plastic materials.

In accordance with other embodiments of the present invention, rather than the closure pin 34 comprising a disposable plastic portion the container 18, the closure pin may comprise for example an elongate cylindrical metal rod with a slot through one side of the tube which may be slid from one side over a flat closed end seam of the closure tube to retain the same against rotation. Similarly, the second end 36 of the tube 30 may be removably secured to the cap 38. For example, the second end 30 of the tube may be welding or bonded to a threaded end adapted to be threadably received into an inlet of the cap 38. Thus, such an arrangement, assembly and disassembly could require threading a new tube 30 into the inlet end of the cap 38 and applying a reusable metal closure pin 34. The new tube 30 could be entirely recyclable material such as plastic or cloth. Many modifications and variations will occur to persons skilled in the art.

Figure 6:
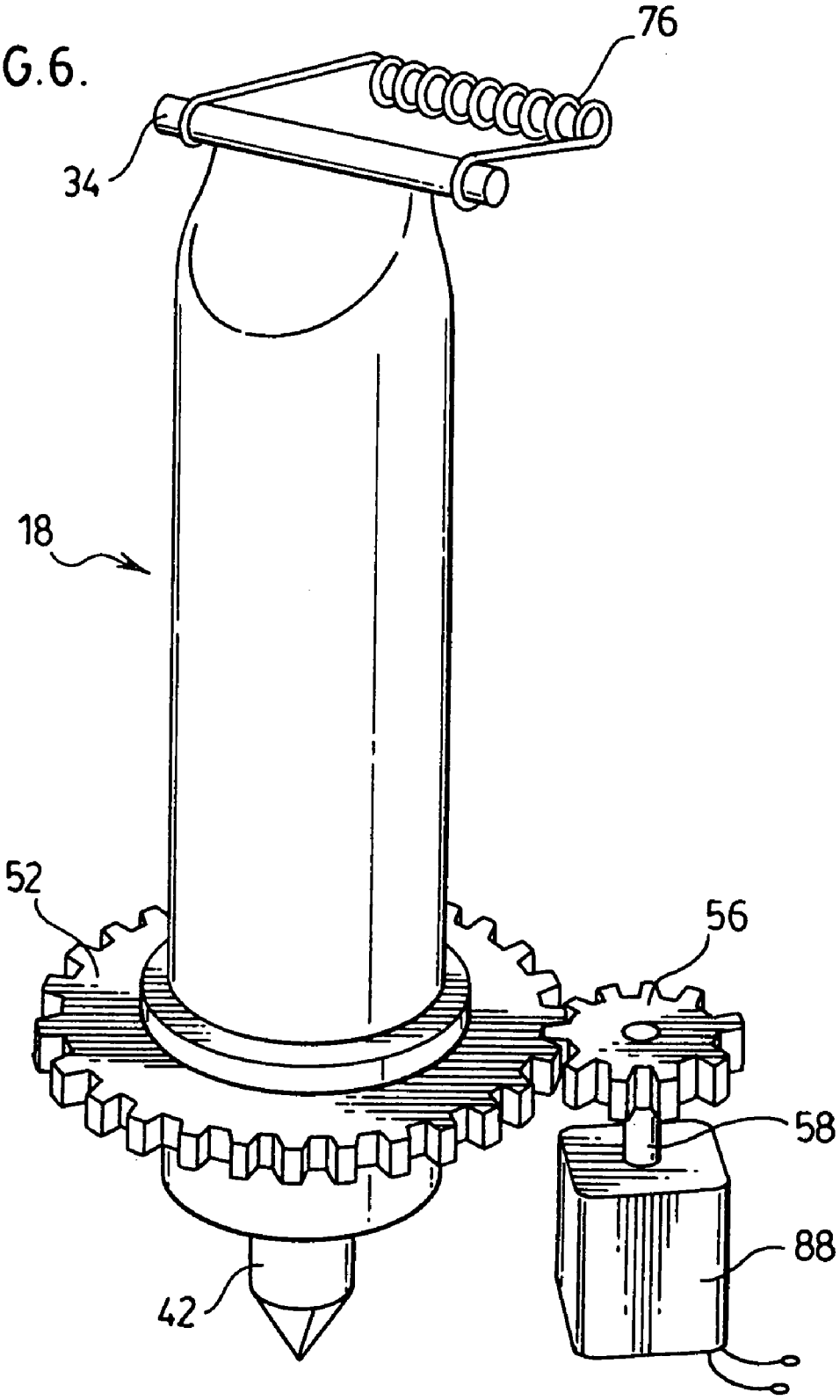
FIG. 6 is a schematic view similar to that of FIG. 4, however, showing the use of a motor rather than a lever.

Reference is made to FIG. 6 which schematically illustrates a container 18 the same as that shown in FIG. 1 to 5, however, having slightly modified gear teeth 56 on the actuation flange 52. In FIG. 6, a motor 88 is illustrated having a drive axle 58 to which a drive gear 56 is coupled. Activation of the motor 88 rotates the gear 56 to rotate the actuation flange 52 and hence rotate the container to dispense fluid. The motor may preferably be an electric motor which may be activated in known manners as by a user pressing a dispense button or by a touchless activation mechanism which would, for example, sense the presence of an object under the nozzle 42. The motor may be driven by electricity from an AC circuit or from batteries. A controller may preferably be provided for the motor. The controller would rotate the container a suitable amount to dispense an individual dosage or allotment of material. Depending upon the nature of the tube and the characteristics of pressure created in the tube upon rotation of the tube, the amount of material which is dispensed with rotation may vary depending upon the extent to which the tube has been twisted from a full position to a substantially twisted empty position. A control mechanism could be arranged to keep track of when a new tube is added and the extent to which the tube has been rotated so as to vary the relative rotation with each successive usage so as to provide for equal dispensed dosages at any time during empting of the tube. As well, the control mechanism may signal when the tube is fully twisted.

The motor preferably has a gear reduction mechanism to provide with a compact and inexpensive low power motor with adequate power to rotate the tube.

Figure 7:
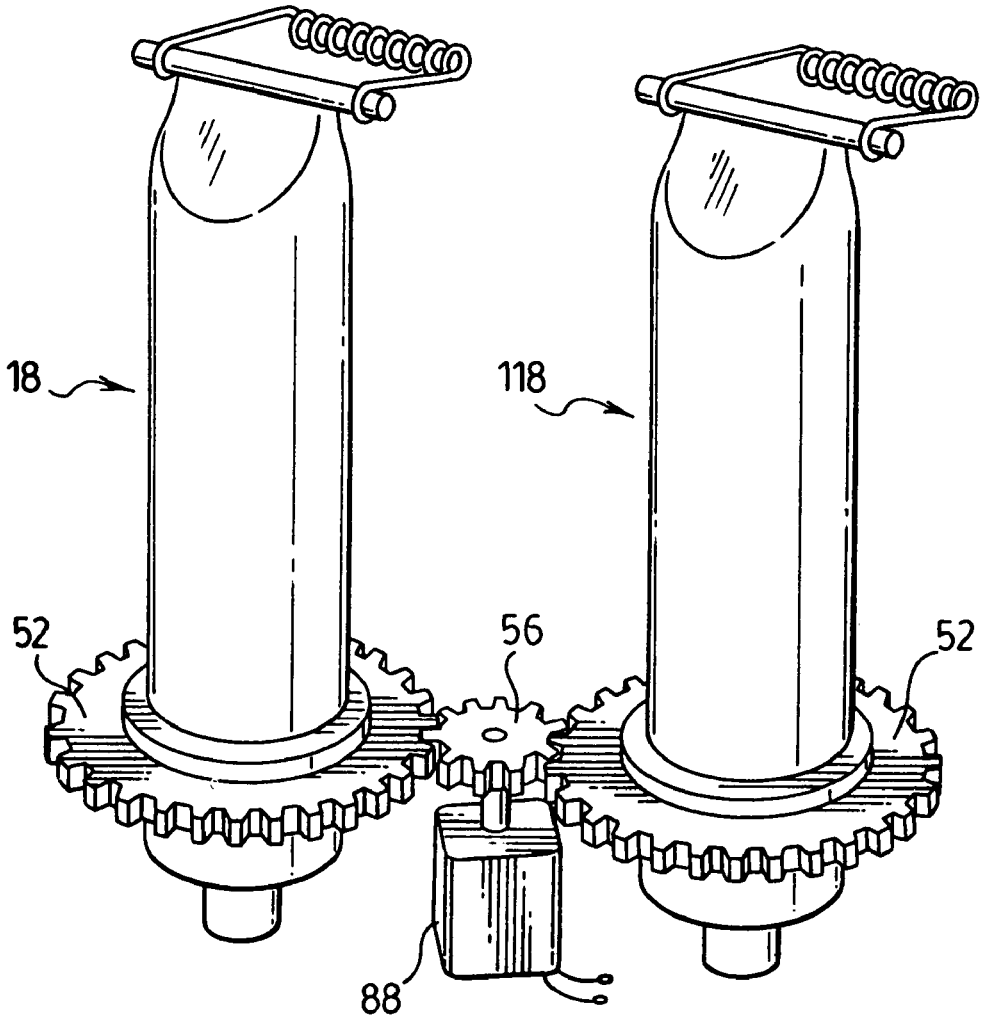
FIG. 7 is a schematic view similar to that of FIG. 6, however, showing a single motor as adapted to simultaneously dispense from two tubes.

Reference is made to FIG. 7 which schematically shows an arrangement in which a dispenser is to have two containers 18 and 118 mounted with the actuation flange 52 of each to be engaged by a gear 56 driven by a single motor 88. One of the containers would be rotated in one direct and the other container would be rotated in the other direction for simultaneous dispensing of material from both containers via their nozzles. While not shown, both the nozzles could join into a single nozzle outlet or at least dispense at substantially the same location as, for example, to apply onto a user's hand or into the same receptacle.

Figure 8:
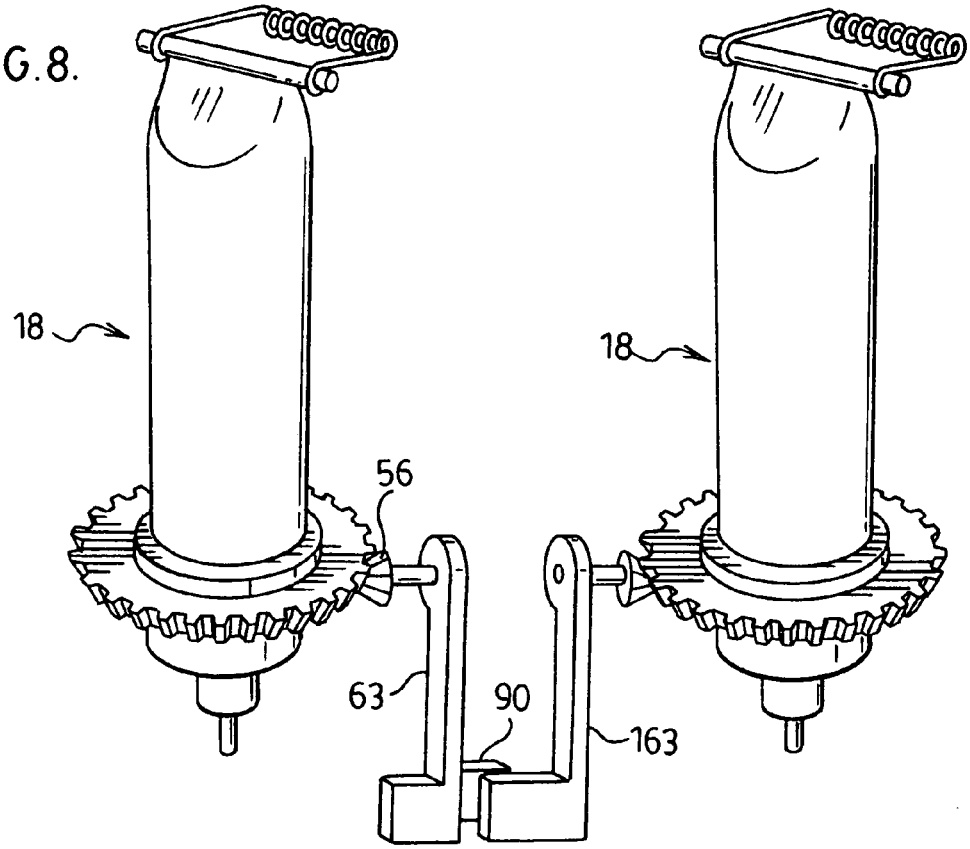
FIG. 8 is a view similar to that of FIG. 7 for dispensing from two tubes but with two levers for manual dispensing.

Reference is made to FIG. 8 which shows an arrangement in which two containers 18 and 118 are arranged in the same dispenser for dispensing by manually activated levers similar to that shown in the embodiment of FIGS. 1 to 5. Two ratchet levers are schematically illustrated. A first lever 63 may independently be operated so as to dispense fluid from the container 18. The first lever has a tab 90 which extends behind a second lever 163. Activation of the second lever 163 will also necessarily move the first lever 63.

Figure 9:
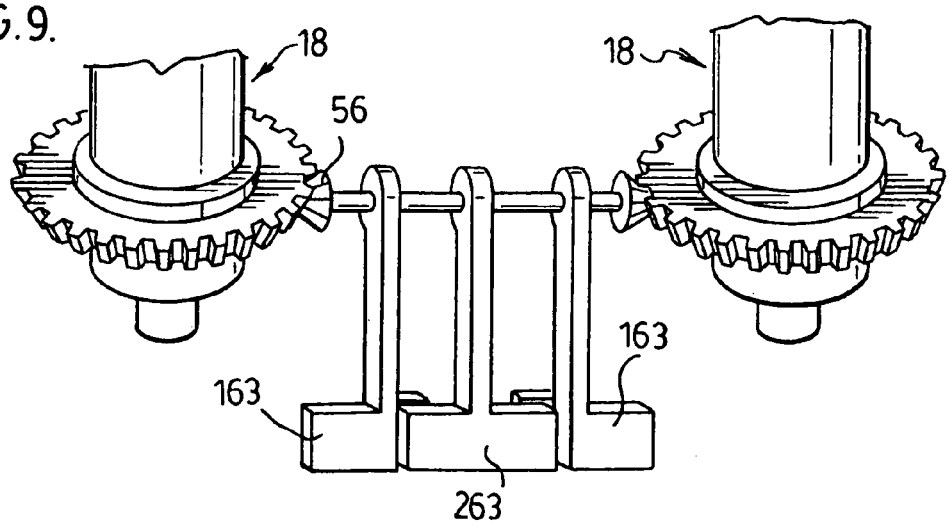
FIG. 9 is a view similar to FIG. 8, however, showing the use of three levers.

Reference is made to FIG. 9 which shows an arrangement similar to that in FIG. 8, however, in which there are three levers. A first lever 63 merely activates dispensing from the first container 18. A second lever 163 merely activates dispensing from the second container 118. A third intermediate 263 lever when activated will move both of the other levers and thus provide for simultaneous dispensing from both containers.

Figure 10:
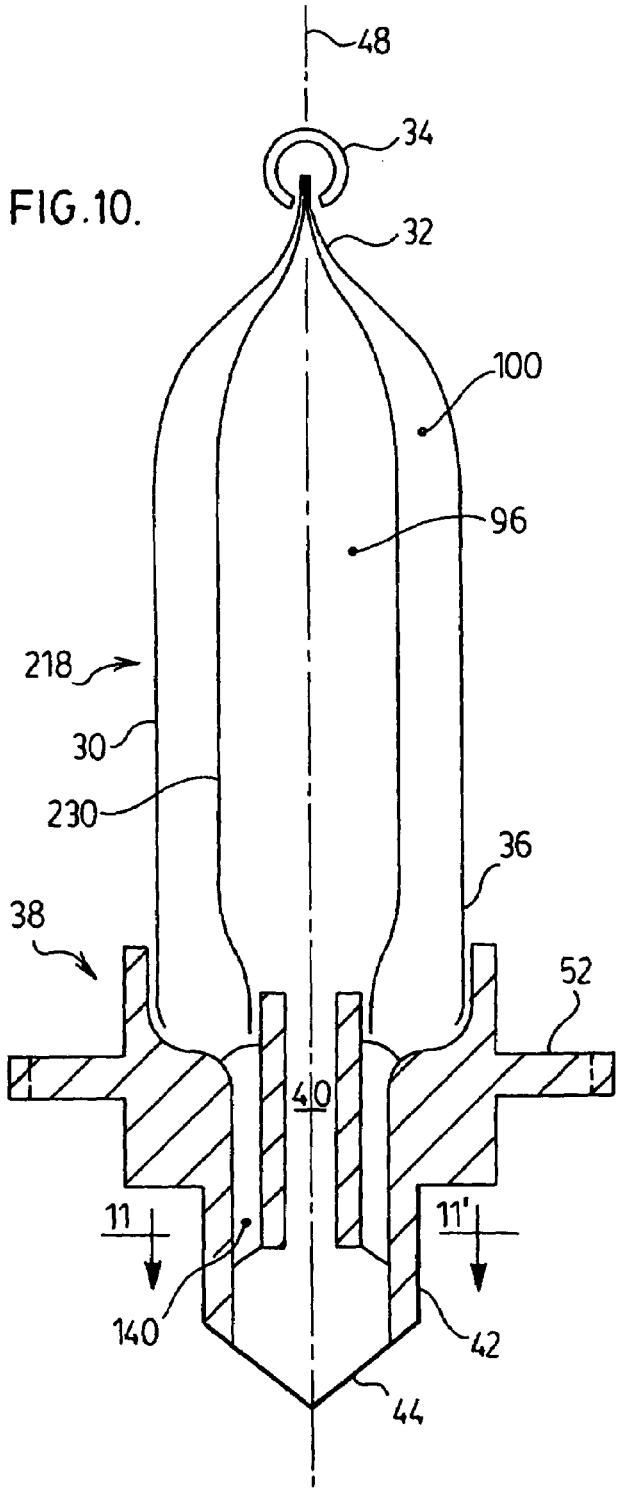
FIG. 10 is a cross-sectional view of another embodiment of a tube for use in the present invention which tube is adapted to carry two products.
Figure 11:
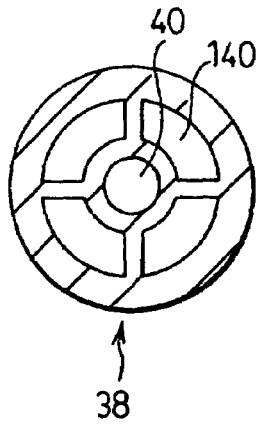
FIG. 11 is a cross-sectional view along section line 11–11' of FIG. 10.

Reference is made to FIG. 10 which illustrates a cross-sectional view through a container 218 in accordance with another aspect of the present invention. The container 218 comprises two coaxial cylindrical tubes namely a first outer tube 30 and a second inner tube 230. The tubes are coaxial about an axis 48 and the inner tube 230 is coaxially received within the outer tube 30. Both tubes are closed at their first ends 32 by a closure pin 34. A cap 38 is engaged on the second end 36 of the tubes.

A first material is received within an inner compartment 96 formed within the inner tube 230. A second material is received within an annular outer compartment 100 defined in the annular space between the inner tube 230 and the outer tube 30.

The cap 38 is formed with an inner passageway 40 in communication with the inner compartment 96 and with an annular outer passageway 140 in communication with an annular outer compartment 100. Each of the passageways 40 and 140 open to a common nozzle 42 with a one-way valve. On relative rotation of the second end of the container 18, compressive forces are applied to the materials in both the inner compartment 96 and the outer compartment 98 and hence both materials will be simultaneously dispensed. The quantity of each of the two components which will be dispensed will depend upon various factors including the relative viscosity of each of the two components and the resistance to flow through the two passageways 40 and 140. Dispensing such that the quantity of one component dispensed bears a relatively fixed proportion to the quantity of the other component dispensed can be arranged with knowledge of their relative viscosities and by suitable selection of the relative size of the two passageways 40 and 140 and thus the resistance to flow there through.

Figure 12:
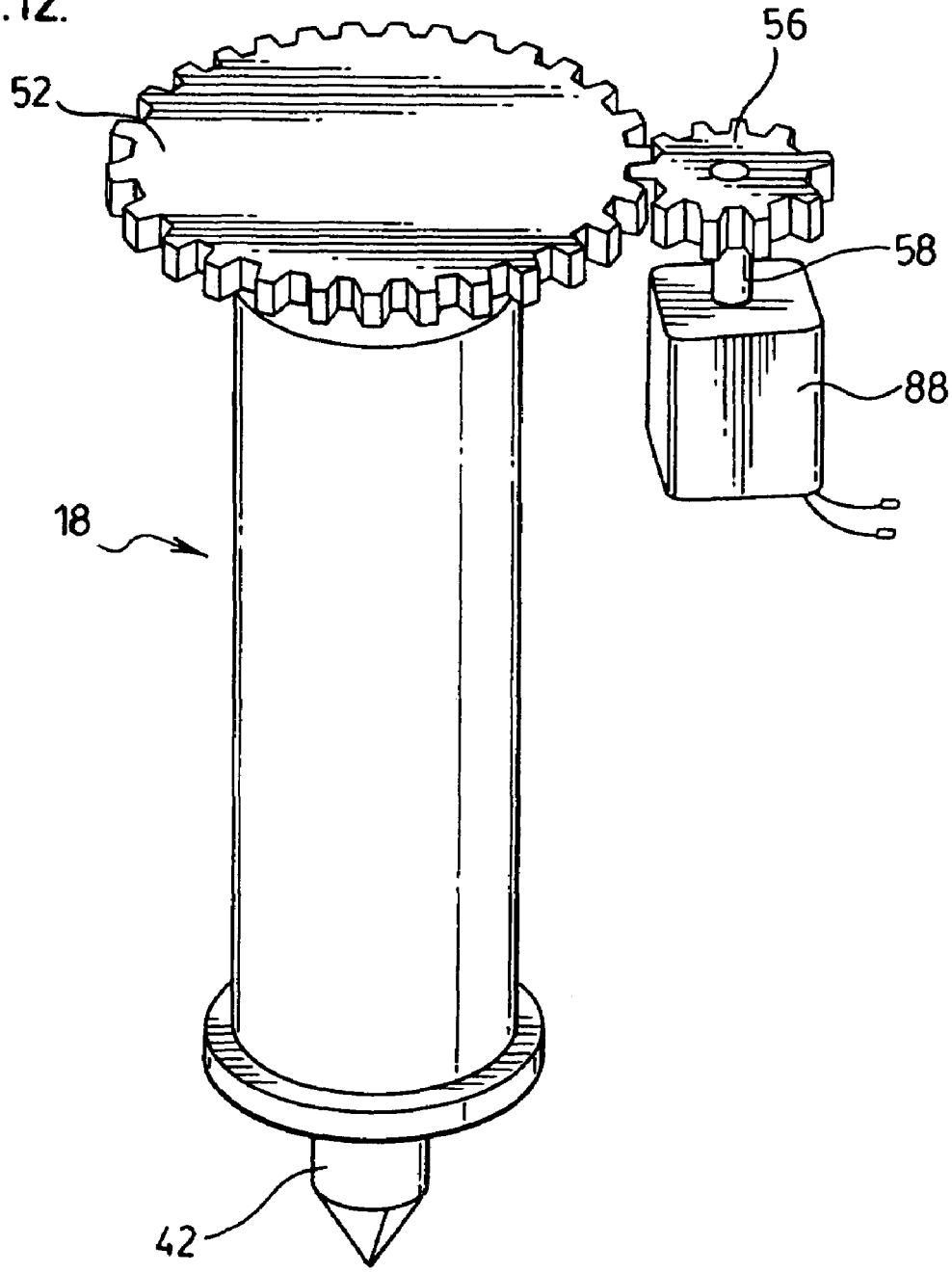
FIG. 12 is a view similar to FIG. 6 but of another embodiment of the invention.
Figure 13:
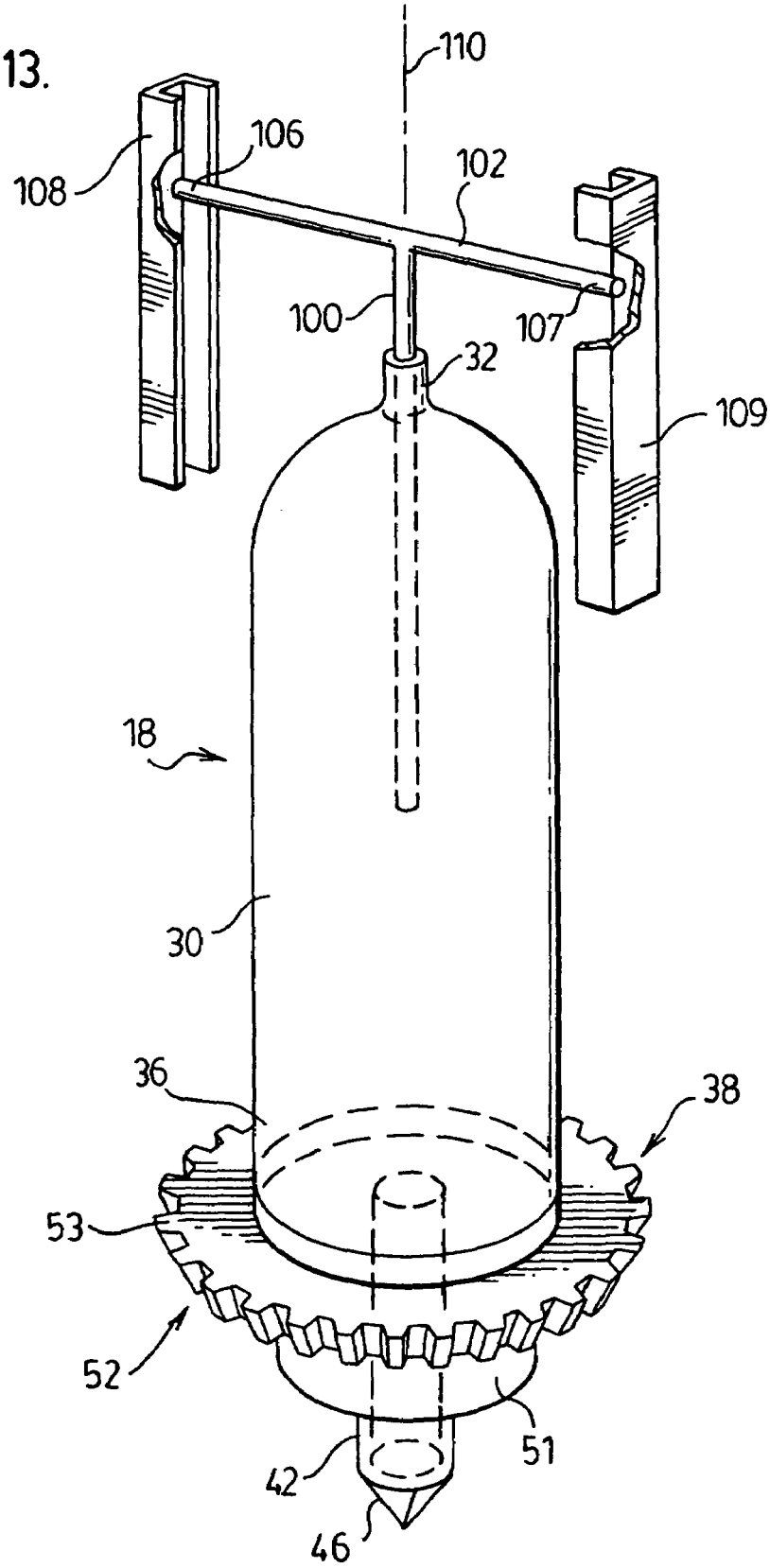
FIG. 13 is a schematic pictorial view of a further embodiment of the present invention.

Reference is made to FIG. 12 which schematically shows an embodiment similar to that in FIG. 6, however, in which the container 18 has a journalled gear 52 secured to a closed first end 32 of a tube 30 and dispensing is from an outlet nozzle 42 at a second end 36 of the tube. A motor 88 is provided to rotate the gear 52 and the first end 32 relative the second end 36. The second end 36 may be held against rotation but may be permitted to slide axially.

Figure 16:
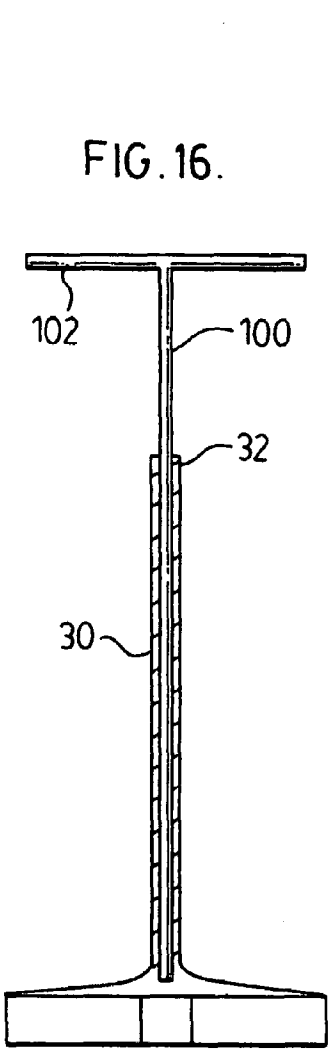
FIGS. 14, 15 and 16 are schematic cross-sectional side views of the dispenser of FIG. 13 in full, partially emptied and emptied configuration respectively.
Figure 15:
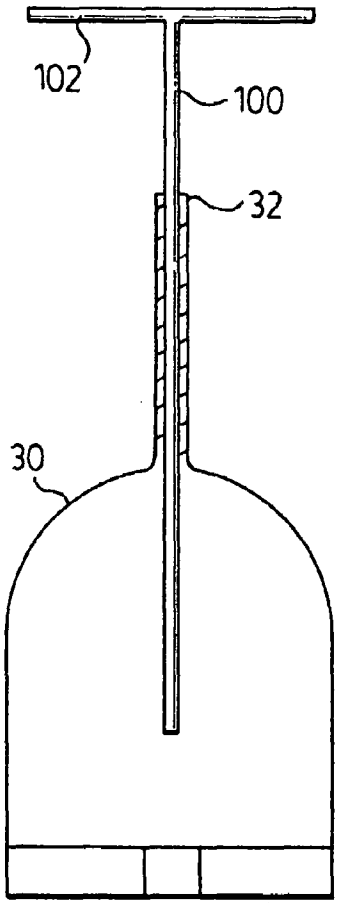
Figure 14:
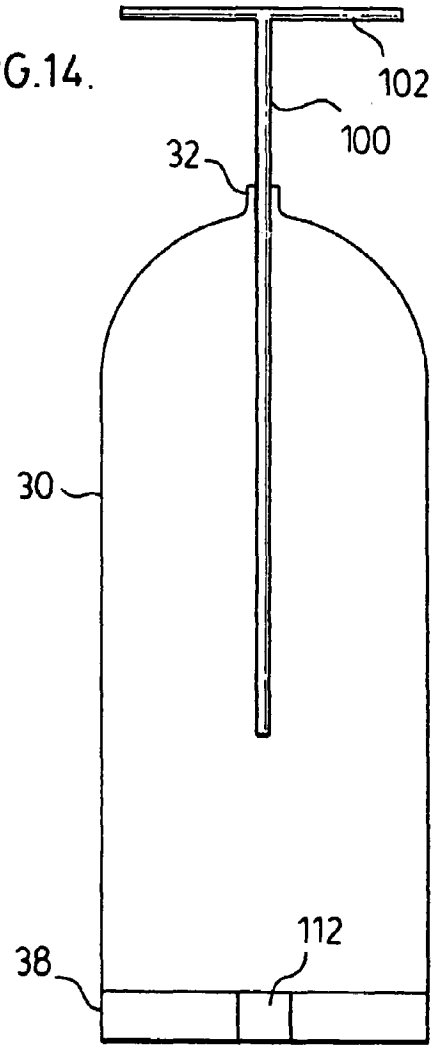

Reference is made to FIG. 13 to 16 which show another paste filled container 18 in accordance with the present invention adapted for use in a housing simlar to that shown in FIG. 1. The container 18 comprises a cylindrical tube 30 having an upper end 32 and a lower end 36. The lower end 36 is sealably secured to a cap 38 substantially the same as that illustrated in FIGS. 1 to 5. The tube 30 is secured as its upper end 32 about an elongate guide rod 100 which extends both upwardly out of the upper end 32 of the tube 30 and downwardly into the tube 30. The upper end 32 of the tube 30 is sealably received on the rod 100 to prevent paste in the tube 30 from exiting the upper end 32. The upper end 32 of the tube 30 is also secured to the rod 100 so as to prevent rotation of the upper end 32 of the tube 30 relative to the rod 100. The rod 100 extends upwardly to a T bar 102 fixedly secured to the upper end of the rod 100. Ends 106 and 107 of the T bar 102 are received in vertically extending U-shaped channels 108 and 109 to prevent rotation of the T bar 102 and therefore the rod 100 about a longitudinal axis 110 through the rod 100 yet permit vertical sliding. The longitudinal axis 110 of the rod 100 is preferably coaxial with an axis 48 about which the tube 30 and its cap 38 are disposed. The channels 108 and 109 may be secured to opposite side walls of a housing such as side walls 22 and 24 in FIG. 1 and may extend a vertical extent as desired. The T bar 102 and channels 108 and 109 in FIG. 13 replace the rod 74 and spring 76 in FIG. 1. A suitable mechanism such as that in FIGS. 1 to 6 may be provided to rotate the cap 38 secured to the lower end 36 of the tube 30 while maintaining the cap 38 fixed at a predetermined height. The cap 38 has an outlet 42 from which paste is to be discharged. On rotation of the cap 38 relative the T bar 102 twisting of the tube 30 results in the side wall of the tube 30 wrapping around the rod 100 progressively downwardly from where the upper end 32 is initially secured to the rod 100. The tube 30 thus collapses by twisting from a full configuration shown in FIG. 14, to the partially emptied configuration shown in FIG. 15 and subsequently to the emptied configuration shown in FIG. 16. With the twisting collapse of the tube 30, the rod 100 moves downwardly relative to the cap 38. The rod 100 provides an internal member about which the tube 30 on twisting may collapse progressively from its upper end as is advantageous towards preventing the tube 30 from twisting to collapse at a location remote from its upper end so as to leave paste caught in the tube 30 between the upper end and a remotely collapsed portion of the tube 30. In FIGS. 14 to 16 as well as in FIGS. 17 and 18 the cap 38 is only schematically shown.

Figure 17:
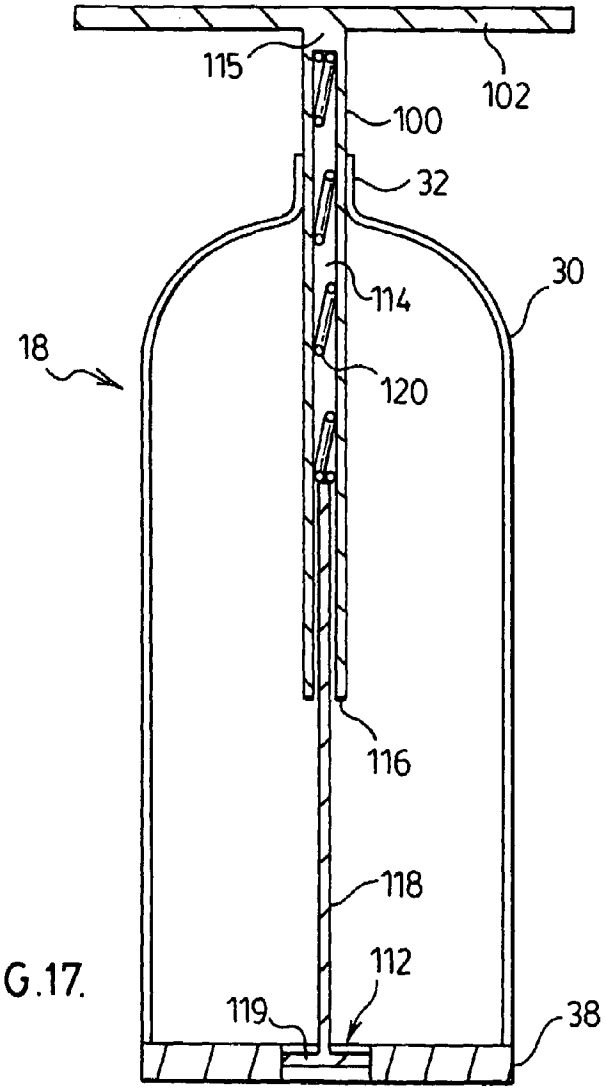
FIG. 17 is a schematic cross-sectional side view of a modified form of a container shown in FIG. 13.

Reference is made to FIG. 17 which shows an embodiment similar to that in FIGS. 13 to 16 but in which the rod 100 is a hollow tube with a central passageway 114 closed an upper end 115 and open at a lower end 116. An elongate guide pin 118 is fixedly secured to the cap 38 as by three radially extending arms 119 which do engage in the outlet channel 112 but do not close the outlet 112. The pin 118 extends upwardly into the central passageway 114 of the rod 100 and is axially slidable therein and rotatable therein. Preferably as shown a helical coil spring 120 is disposed in the passageway 114 and bias the pin 118 out of the passageway 114, and thereby biasing the rod 100 upwardly so as to bias tube 30 toward an extended position.

Figure 18:
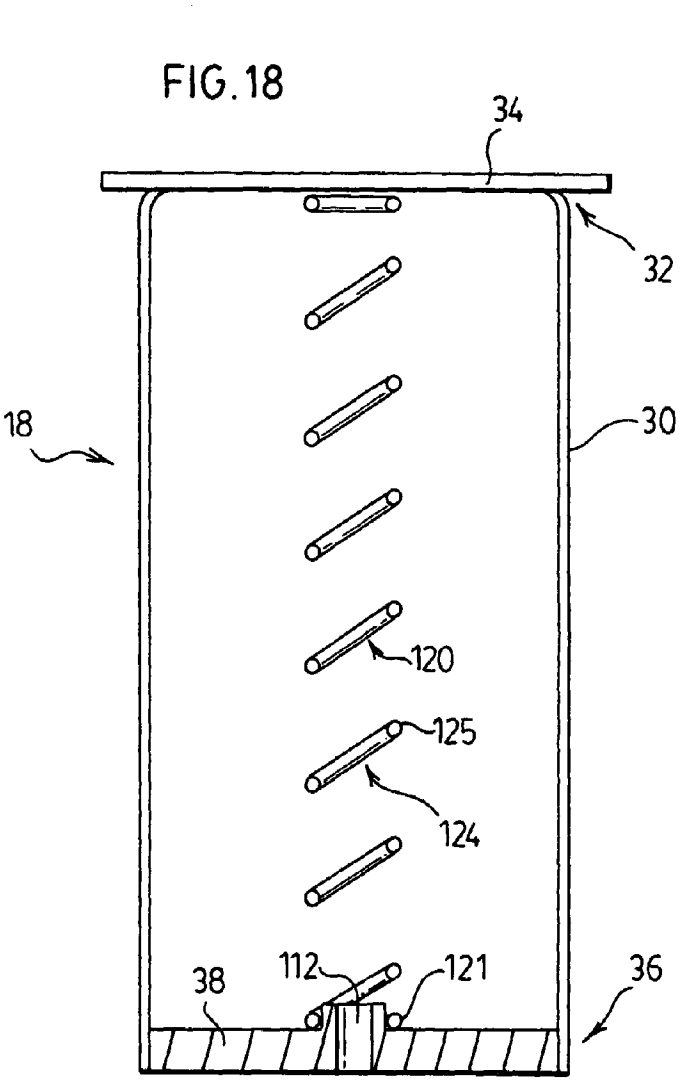
FIG. 18 is a schematic cross-sectional view of a further modified from a container as shown in FIG. 13.

Reference is made to FIG. 18 illustrating a further embodiment of a container 18 in accordance with the present invention, similar to the configuration in FIG. 1 in having a closure pin 34 clamp shot the upper end 32 of the tube 30. A closure cap 38 closes the lower end 36 of the tube 30. A helical spring 120 is provided inside the tube 30 with a lower end 121 coupled to the cap 38 about the outlet 112. On twisting the tube 30, the tube 30 will become wound about the spring 120 in a similar manner that the tube 30 becomes wound about the rod 100 in FIGS. 13 to 17. With twisting of the tube 30, the tube 30 will axially compress the spring 120 and move the upper end of the spring 120 downwardly. The spring 120 provides an internal passageway 124 inside its coils 125 in communication with the exit passageway 112. If twisting of the tube 30 onto the spring 120 does not commence at the uppermost end of the spring 120, the passageway 124 provides for a central passage to the exit passageway 112 which is open throughout the height of the spring 120. While the spring 120 is shown as a helical it could reduce in diameter from its upper end downwardly. Rather than a helical spring, a central tube formed of one or more telescoping elements and with radial openings through the tubes may be used, possibly in combination with an internal helical spring.

Figure 20:
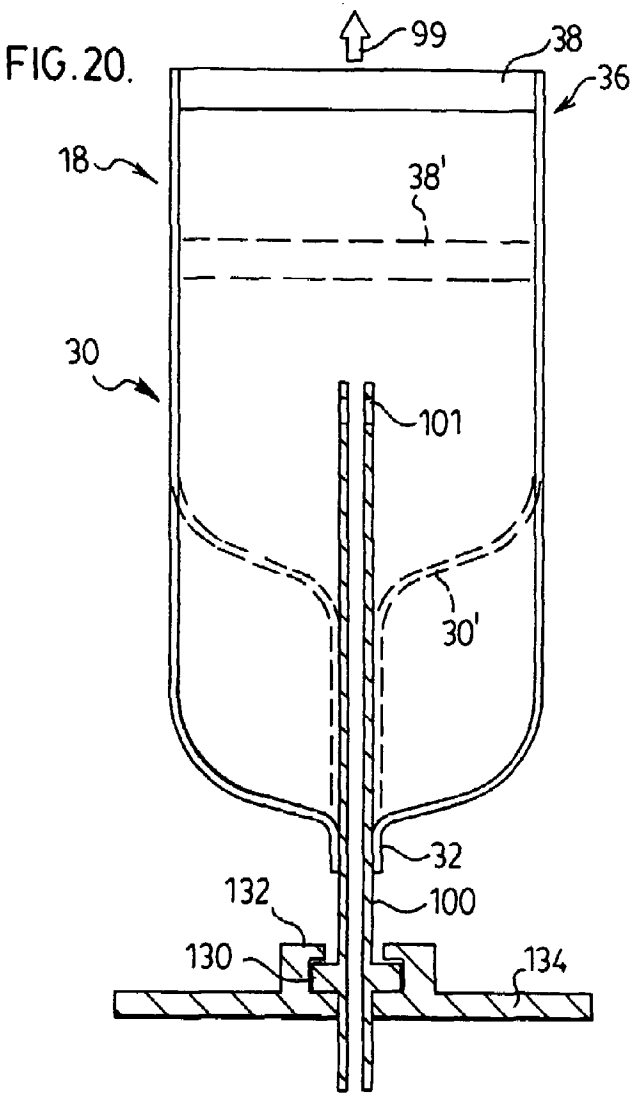
FIG. 20 is a schematic partial side view of the dispenser in FIG. 20.
Figure 19:
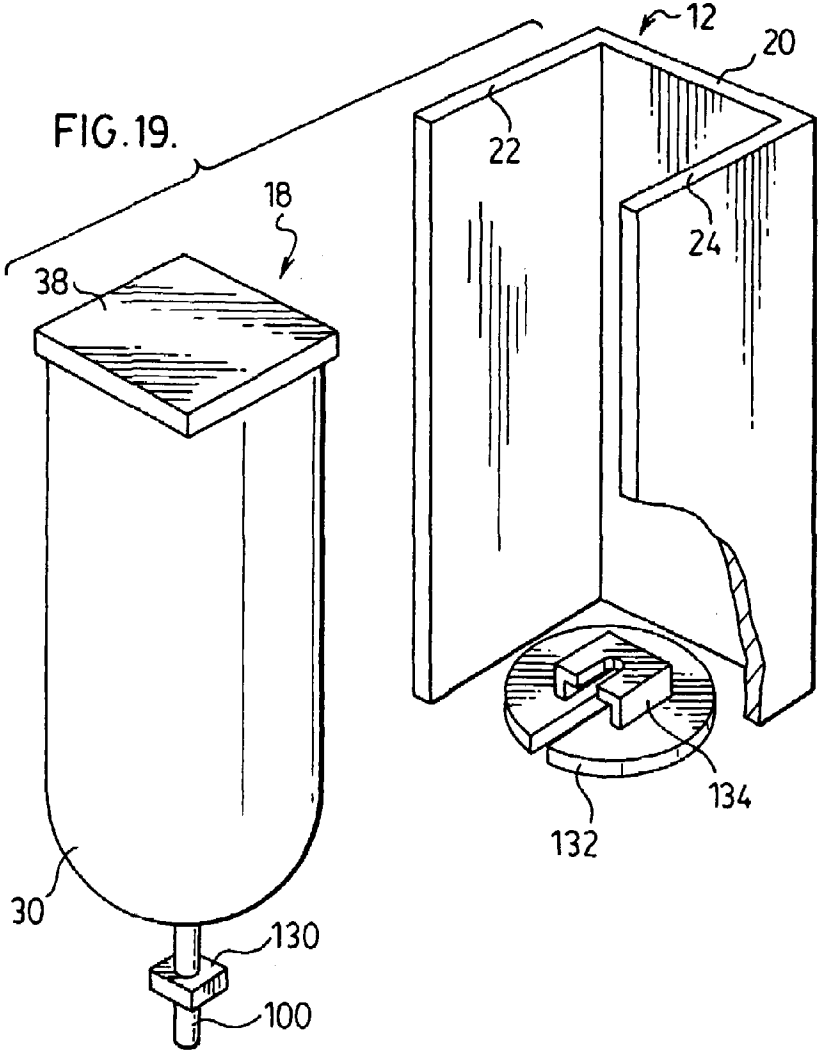
FIG. 19 is a schematic exploded pictorial view of a dispenser in accordance with a further embodiment of the invention.

Reference is made to FIGS. 19 and 20 showing an embodiment in which the cap 38 is shown at the upper end 36 of the tube 30 and the lower end 32 in is secured to a hollow rod 100. With relative rotation of the cap 38 relative the tube 38, the tube 30 is wound about the rod 100 collapsing the tube 30 and urging paste out through the hollow tube 100. With a spring such as that shown in FIG. 1 as 76 tending forces to elongate tube 30 axially as in the direction of arrow 99 in FIG. 20, the tube 30 will twist to collapse about the rod 100. FIG. 20 shows in dashed lines a partially empty container with the tube 30 having been twisted onto the rod 100 and the cap 38 having been drawn downwardly. To assist fluid flow into the hollow rod 100, the side wall of the rod 100 may be perforated with openings 101.

The hollow rod 100 may carry an integral flange 130 which is polygonal in cross-section normal the axis of the rod 100. The flange 130 is adapted for removal from and engagement with a rotatable member 134 rotatably carried in a housing 12 for rotation to twist the tube 30. The flange 130 may be slid between two plates 132 and the member 134 to be received in a position to be rotated.

FIG. 20 shows a cross-section of the container 18 in FIG. 19. The cap 38 is shown as square and sized to fit inside the side walls 22 and 24 of the housing 12 to prevent rotation of the cap 38 relative the housing but to permit vertical sliding. The flange 130 secured to the tube 100 is also shown as square. The tube 100 and its flange 130 are to be slid radially between rotatable plates 132 and 134 for rotation therewith. While not shown, plate 132 is rotatable relative to the housing at a fixed vertical position on the housing. A biasing mechanism not shown is to be provided to bias the cap 38 upwardly. The biasing mechanism preferably is external to the container 18 and a reusable part of the housing.

Figure 22:
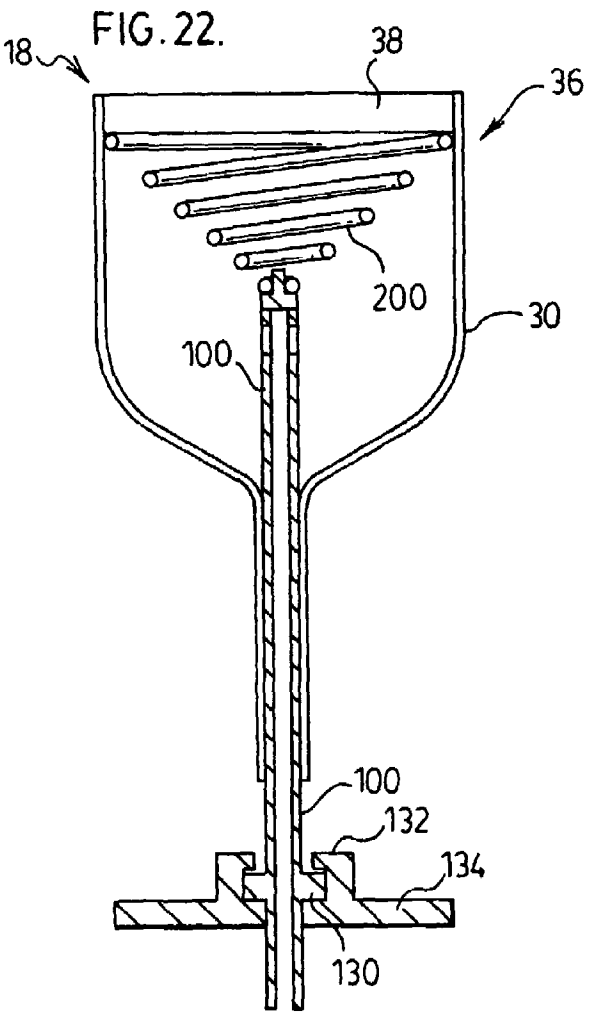
FIGS. 21 and 22 are a schematic cross-sectional side view of a modified form of the dispenser of FIG. 20 in full and partially emptied configuration, respectively.
Figure 21:
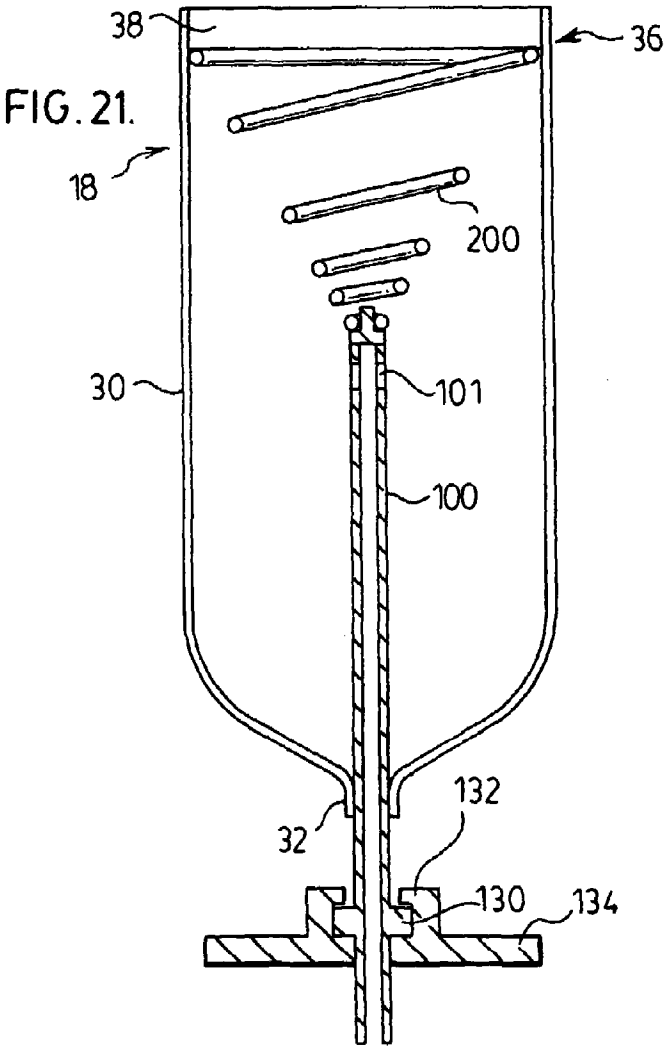

FIGS. 21 and 22 show an embodiment of the container the same as in FIG. 20 but with an internal fructoconical helical spring 200 biasing the cap 38 away from an upper end of the rod 100. The spring 200 is collapsible upon itself as seen in FIG. 22 showing a partially collapsed configuration. The spring 200 may fully collapse so that all its coils lie in a flat plane. The spring 200 may comprise a light duty spring of resilient plastic.

Dispensers in accordance with the present invention are adapted to dispense a wide variety of flowable products including liquids, slurries and flowable particulate solid matters. Such products include highly viscous toothpaste, engine oil, lubricating oil, epoxy resins, lard, mustard, ketchup, honey, granular pumice soap, paint, paint tints, icing, cleansers, caulking compounds and roofing tar.

The tube illustrated in the preferred embodiment is cylindrical about the axis 48. Other preferred configurations include a tube which is circular in any cross-sectional normal the axis, and a tube which is frustoconical about the axis. The tube may have any shape which accommodates extrusion of material therefrom on twisting of the tube. Shapes which are not coaxial to the axis 48 may be used. The tube may be formed as by extrusion processes. Tubes which are multiple layer and formed by co-extrusion may have enhanced permeability and strength characteristics, yet are inexpensive. To prevent twisting from causing closure of the tube with substantial material trapped upstream therefrom, a mechanism like a helical coil spring may be provided to extend axially through the tube.

While the invention has been described with reference to preferred embodiments, many modifications and variations will now occur to persons skilled in the art. For a definition of the invention reference is made to the appending claims.

I claim:

1. A dispenser for material comprising:

a collapsible container elongate about an axis from a first end to a second end, the container closed but for an outlet open at one of the first end and the second end, a housing to receive the container with the first end of the container coupled to the housing substantially against rotation about the axis relative to the housing, the second end of the container coupled in the housing journalled for rotation about the axis in a first direction and against rotation in an opposite direction to the first direction, an activation mechanism for rotating the second end of the container in the one direction, whereby rotating the second end of the container about the axis twist the container about the axis compressing material therein and extruding the material from the outlet.

2. A dispenser as claimed in claim 1 wherein the container comprises a tube elongate about the axis.

3. A dispenser as claimed in claim 1 wherein the container comprises a tube selected from a tube which is circular in cross-section about the axis, a tube which is cylindrical about the axis, and a tube which is frustoconical about the axis.

4. A dispenser as claimed in claim 1 wherein the container carries a cap secured to the tube at the second end for rotation therewith about the axis in the one direction, the cap carrying bearing surfaces to engage bearing surfaces of the housing and journal the cap to the housing for rotation about the axis, the cap having an inlet opening securely receiving the second end of the tube and in communication with the outlet of the container, the cap having an outlet nozzle out of which material is to be dispensed, the inlet opening of the cap in communication with the outlet nozzle.

5. A dispenser as claimed in claim 4 including a ratchet mechanism which provides for rotation of the container in the first direction and prevents rotation of the container in the opposite direction.

6. A dispenser as claimed in claim 5 wherein the cap carries an activation flange which extends radially outwardly from the cap about the axis so as to present an activation surface which is generally cylindrically about the axis and adapted for engagement to rotate the container in the first direction.

7. A dispenser as claimed in claim 1 including a retainer mechanism carried in the housing to secure the first end of the container to the housing against rotation of the first end of the container relative to the second end of the container.

8. A dispenser as claimed in claim 7 wherein the cap and the retainer mechanism are mounted in the housing such that the axial distance therebetween may vary to accommodate changes in the length of the container with rotation of the second end of the container in the first direction.

9. A dispenser as claimed in claim 8 wherein the cap carries a radially outwardly extending substantially cylindrical flange carrying gear teeth thereon for engagement by an activation mechanism to rotate the cap.

10. A dispenser as claimed in claim 9 wherein the activation mechanism is selected from a manually operated lever connected via a ratchet mechanism to a drive gear engaging the gear teeth on the cap and a motor operatively coupled to a drive gear engaging the gear teeth on the cap.

11. A dispenser as claimed in claim 1 including two said containers independently mounted for rotation about their respective axes with the activation mechanism selected from one which provides independent rotation of each container and simultaneous rotation of both containers.

12. A dispenser a claimed in claim 1 wherein the container comprises an outer cylindrical tubular member and an inner cylindrical tubular member, the inner tubular member being coaxially received within the outer tubular member, each of the first and second tubular members being closed at the first end and open at the second end to the outlet, a first material containment compartment being formed internally within the inner tubular member, a second material compartment being formed within an annular space in between the inner tubular member and the outer tubular member, wherein rotation of the second end of the tube relative to the first end extrudes both the first material and the second material from the outlet of the tube simultaneously.

13. A dispenser as claimed in claim 4 including a one-way valve in the outlet nozzle of the cap permitting flow of material outwardly from the cap.

14. A dispenser as claimed in claim 1 including an elongate member disposed centrally within the container along the axis and having a first end and a second end, wherein on rotating the second end of the container about the axis, the container twists about the axis and collapses on the elongate member internally within the container.

15. A dispenser as claimed in claim 14 wherein the container is secured about the first end of the elongate member at the one of the first end and the second end of the container remote from the outlet.

16. A dispenser as claimed in claim 15 wherein the elongate member has a central passageway therethrough and openings radially into the central passageway along the length of the elongate member, and an exit opening at the second end of the elongate member.

17. A dispenser as claimed in claim 16 wherein the elongate member is a coil spring.

18. A dispenser as claimed in claim 14 wherein the elongate member has the container received thereabout at one of the first end and the second end of the container, the elongate member extends from the one of the first end and second end of the container internally of the container to present one of the first end and second end of the elongate member internally within the container as a free end, a spring coupled between the free end and the one of the first end and second end of the container remote from the outlet so as to bias the first end and second end of the container axially apart.

19. A dispenser as claimed in claim 14 wherein an external portion the elongate member extends out of the container from where the container is secured about the elongate member, the elongate member secured to the container against relative rotation about the axis, the external portion of the container either engaged by the housing to secure the first end of the container to the housing against rotation or engaged by the actuation mechanism for rotation of the second end of the container about the axis.

20. A dispenser as claimed in claim 14 wherein the elongate member having a central passageway therethrough open to an exit opening at the second end and one or more inlet opening into the central passageway at the first end of the elongate member or radially into the central passageway along the length of the elongate member;

the container is secured about the second end of the elongate member at the one of the first end and second end of the container carrying the outlet with the exit opening of the elongate member in communication with the outlet.

21. A dispenser as claimed in claim 14 wherein the elongate member having a central passageway therethrough open to an exit opening at the second end and one or more inlet opening into the central passageway at the first end of the elongate member or radially into the central passageway along the length of the elongate member;

the container is secured about the elongate member intermediate the first end and second end of the elongate member with the elongate member extending through the outlet to present the exit opening external of the container, and with the one or more inlet openings internal of the container.

22. A dispenser as claimed in claim 14 wherein the elongate member carries external of the chamber an engagement member for engagement by the activation mechanism for rotation relative the housing or by the housing against rotation relative the housing.

* * * * *